US009446298B2

(12) United States Patent
Keehu

(10) Patent No.: US 9,446,298 B2
(45) Date of Patent: Sep. 20, 2016

(54) ROLLER HOCKEY GOALIE APPARATUS

(71) Applicant: Ioane Keehu, Honolulu, HI (US)

(72) Inventor: Ioane Keehu, Honolulu, HI (US)

( * ) Notice: Subject to any disclaimer, the term of this patent is extended or adjusted under 35 U.S.C. 154(b) by 741 days.

(21) Appl. No.: 13/861,309

(22) Filed: Apr. 11, 2013

(65) Prior Publication Data

US 2014/0082812 A1 Mar. 27, 2014

Related U.S. Application Data

(60) Provisional application No. 61/706,430, filed on Sep. 27, 2012.

(51) Int. Cl.
*A63B 71/12* (2006.01)
*A63B 71/02* (2006.01)

(52) U.S. Cl.
CPC ..... *A63B 71/1225* (2013.01); *A63B 2071/025* (2013.01); *A63B 2102/24* (2015.10)

(58) Field of Classification Search
CPC ..... A63B 2102/24; A63B 71/1225; A63B 2071/1241; A63B 2071/1266
See application file for complete search history.

(56) References Cited

U.S. PATENT DOCUMENTS

| | | | | |
|---|---|---|---|---|
| 3,529,825 | A * | 9/1970 | White, Sr. | A63B 59/70 473/328 |
| 4,868,926 | A | 9/1989 | Lowson | |
| 5,617,580 | A | 4/1997 | DiCesare | |
| 5,794,275 | A | 8/1998 | Denzis | |
| 5,800,312 | A | 9/1998 | Ormondroyd | |
| 6,510,560 | B1 * | 1/2003 | Ugolnik | A41D 13/0015 2/22 |
| 9,414,158 | | 1/2003 | Ugolnik | |
| 6,845,523 | B2 | 1/2005 | Copp | |
| 7,681,248 | B2 | 3/2010 | Legenstein | |
| 9,095,179 | B2 * | 8/2015 | Kwan | A41D 13/015 |
| 2004/0108074 | A1 | 6/2004 | Marchetti | |
| 2005/0015841 | A1 | 1/2005 | Hoffman | |
| 2008/0201814 | A1 * | 8/2008 | Goyer | A41D 13/0543 2/22 |

* cited by examiner

*Primary Examiner* — Shaun R Hurley
*Assistant Examiner* — Andrew W Sutton
(74) *Attorney, Agent, or Firm* — Steven R. Gray; Holland & Hart LLP

(57) ABSTRACT

A roller apparatus that either attaches to or is incorporated into a roller hockey goalie leg protective member, allowing simulation of "on ice" motion. Rolling may be accomplished through a plurality of ball bearings, protruding from a plane of an apparatus, as well as a plurality of cavities wherein ball bearings may be housed. A recess in the cavities may allow for impact to be absorbed while still allowing the ball bearings to freely roll in one or preferably every direction. Apparatus containing ball bearings may be located on the landings of a roller hockey goalie leg protective member, or other areas most likely to come in contact with a dry surface.

20 Claims, 13 Drawing Sheets

ROLLER HOCKEY GOALIE APPARATUS

BACKGROUND OF INVENTION AND DESCRIPTION OF PRIOR ART

1. Background of in-Line Hockey

In the latter part of the 19$^{th}$ century, ice hockey is said to have been first played on frozen ponds or lakes, with two stones frozen on each opposite end. As many as thirty players on each side would use sticks of wood with flat blades to try to score a goal by getting a puck in between the two stones. The popularity of the sport spread from North American to other continents. Ice hockey rules were eventually standardized, calling for five players and a goalie to represent each opposing team in the ice rink at a time.

Early ice hockey players yearned to continue playing the "on-ice" sport even when warmer weather melted their ice rinks. Consequently, and due to the invention of quad roller skates (comprising two wheels in front, two wheels in back), the game of roller hockey was developed. Quad roller skates had their limitations, however, such as not allowing players to move with the same speed as "on-ice" play. Roller hockey rules attempted to compensate for these differences by, among other changes, requiring that the game be played with four players and a goalie at a time (per team), to allow for more freedom of movement.

Over the ensuing decades, the game of roller hockey gained popularity culminating in 1984, when an improved alternative to quad roller skates came about with the filing of a patent for "inline" skates: "boots equipped with longitudinally aligned rollers used for skating." Inline skates allowed hockey players to more closely simulate the "on-ice" feel than quad roller skates by allowing, for example, greater maneuverability and speed. Due to the advantages of inline skates over quad roller skates, inline hockey has since become more popular than roller hockey in the U.S.

2. Background of Hockey Goalie Leg Protective Members

Although inline skates helped replicate the "on-ice" feel for most inline hockey players, there was no similar advancement in technology applicable to hockey goalies playing on dry surfaces. This was probably at least in part due to the fact that the techniques and on-ice movements of ice hockey goalies, and the related designs of their leg protective members, have significantly evolved since inline skates were created and started gaining popularity.

Specifically, older styles of hockey goalie leg protective members were tightly strapped to the legs. The goalie using this older style of protective members, to block pucks from entering the goal, would go straight from a standing position to a kneeling position. In so doing, the face of the leg protective members above the knees would remain facing outward towards the shooter. Below the knees, however, the face of the leg protective members would be parallel with, and face directly towards, the ice surface. In other words, hockey goalies using older goalie technique and styles of leg protective members did not rotate their legs, and leg protective members were designed accordingly. Since such a non-rotating, reactionary, movement would not leave exposed much (if any) of the goalie's inner legs, the designs of older styles of goalie leg protective members did not include much padding protecting the inner legs.

Starting around 2000, however, "box" style leg protective members became popular as goaltending playing technique evolved from a reacting style to a "blocking" style. Specifically, instead of simply reacting to a shot on goal by kneeling straight down from a standing position, in modern hockey play a goalie will prevent a puck from entering the goal (among other techniques) by using leg protective members to maximize the blocking area of the lower part of a goal. This modern "blocking" technique is accomplished by simultaneously kneeling and extending the part of the legs below the knees away from the body, with the inner part of the lower legs facing the surface and both lower legs pointing in opposite directions (the legs together essentially forming an upside down "T"). This position is colloquially referred to as the "butterfly" position.

Since a hockey goalie in the "butterfly" position can maximize blocking area by keeping the face of the protective member perpendicular with the ice surface, the design of goalie leg protective members evolved into more of a "box" style, where the edge between a face of the protective member and the inside edge is square-shaped. Thus, the modern box style of hockey goalie leg protective member anticipates that the pad may move or rotate from a vertical position (when the goalie is standing) to a horizontal position, when the goalie is in a kneeling (or rather in the "butterfly") position. In this manner, all of a "face" of the leg protective member may be directed straight towards the shooter, rather than the ice.

Thus, modern hockey goalie leg protective members are designed with padding in the inner knee and inner calf/shin areas, which padded areas are called "landings" or "wraps." Such padding softens impact in the primary locations where much of the goalie's body weight may fall when transitioning from the standing to kneeling position. "Landings" are not only intended to soften impact, but also to allow a goalie to move over an ice surface in a fluid manner.

3. Description of Prior Art

There is a need for some apparatus that would allow a hockey goalie's motion during play on a dry surface to simulate "on-ice" motion. A hockey goalie playing on a dry surface may often have to repeat a standing and the kneeling movement in order to achieve certain positions that might otherwise be attained more quickly and easily on an ice surface. Such excessive and potentially burdensome movements can lead to undue exertion, pain, stress, and injury to a goalie's knees, hips and lower back. Furthermore, the added concentration and time necessary to perform blocking movements on a dry surface can make the difference between blocking and failing to block a puck from entering the goal.

In the prior art, there are no apparatuses utilizing rolling means that sufficiently allow a hockey goalie to simulate the motion experienced on an ice surface, on a dry surface, especially when the goalie is moving to or is in a kneeling or "butterfly position." Additionally, there is also a need in the market for such an apparatus that can attach to existing protective leg members, without a hockey goalie having to purchase a separate set of hockey goalie leg protective members made specifically for play on a dry surface. This need is felt not only by hockey goalies for hockey play on a dry surface but is also felt by ice hockey goalies, who may lack access to an ice hockey rink for training purposes, yet wish to train on a dry surface.

SUMMARY OF THE INVENTION

A principal object of the invention is to assist a roller hockey goalie simulate "on ice" motion on a dry surface. In addition to forward and backward motion, such "on ice" simulated motion may also include lateral (or semi-lateral) motion, even when a goalie is transitioning from a standing to a kneeling position, or in a position colloquially referred to by hockey enthusiasts as the "butterfly" position (kneeling with the lower legs below the knees pointed in opposite directions away from the body, with the inner legs facing the dry surface).

Such an apparatus allowing "on-ice" motion by rolling may attach to a roller hockey goalie leg protective member or may also be incorporated into a roller hockey goalie leg protective member. The apparatus may be located in areas of a protective leg member that may be in contact with a dry surface, or where the weight of a hockey goalie's body and equipment is most likely to impact the dry playing surface. Given currently prevalent designs of hockey goalie leg protective members, it is anticipated that these areas of likely impact with a dry surface may be the "landings" of a hockey goalie protective leg member.

An apparatus that allows simulation of "on-ice" motion may accomplish such motion through utilization of ball bearings, and designs allowing the ball bearings to roll easily (and continue to roll easily) over a dry surface even when (or after) absorbing impact. Embodiments of the apparatus may utilize any rigid, loose spherical or rounded object that protrudes from one surface of the apparatus, but is basically contained in and rolls easily within the apparatus in at least one (and preferably every) direction, even after absorbing impact.

Each individual ball bearing may be contained in the apparatus within a cavity. A plurality of such cavities may perforate a plate component of the apparatus. This plate may be comprised of a self lubricating plastic, such as, by way of example, Ultra High Molecular Weight (UHMW) Polyethylene. (It is anticipated, however, that many different materials may comprise the apparatus and the parts thereof, according to cost of production concerns, coefficients of friction, self-lubrication, impact tolerance, durability, etc.). The cavities in the plate may be partially closed at one end, with the aperture being less wide than the diameter of the ball bearing, thus allowing the ball bearing to protrude yet not allowing it to escape from the aperture.

Additionally, inside each cavity may be a small amount of extra space, in addition to that necessary to house the ball bearing and keep it loose enough to roll, which may allow for impact absorption (i.e., allow the ball bearing to move further into the cavity) without substantially impeding the freedom of the ball bearing to roll. A cap piece may also be placed on the opposite side of the plate (opposite from the end with the aperture less wide than a ball bearing's diameter), which may be made of somewhat flexible material, thus allowing for additional impact absorption and freedom of the ball bearing to roll.

Different embodiments are anticipated where the pluralities of ball bearings and cavities have different configurations and designs to allow for greater desired mobility. For example, certain patterns of ball bearings may facilitate movement more aligned with a hockey goalie's leg, foot, and knee axes. Rectangular and/or other arrays of ball bearings may also present certain advantages.

Alternative embodiments may also be presented according to playing surface (e.g., the density, or coefficient of friction, of the surface) and environment. For example, one embodiment of the apparatus may be designed for use during actual roller hockey play on a dry surface, while other embodiments may be specifically designed for use on concrete, or carpets. Such alternative designs might include varying sizes of ball bearings and degrees to which the ball bearings may protrude. Larger ball bearings may raise a protective member higher off the ground in some embodiments, which may allow for greater mobility, while smaller ball bearings might bring the protective member closer to the floor while still allowing a desired amount of mobility (on the other hand, bringing a protective member closer to the floor in some embodiments might be desirable). For use on an asphalt surface, or even on a carpeted surface, less mobile plastic ball bearings (or ball bearings with greater resistance to movement) may be desired. Similarly, other embodiments might not use ball bearings at all, but rather use other rolling or other means (e.g., nubs), for achieving a similar type of motion.

Furthermore, although two preferred rolling embodiments of the apparatus are described below, for use in the knee area and in the calf/shin/foot area, different sizes and shapes of the apparatus are anticipated, according to (among other things) the area or type of protective member, or depending on whether the embodiment of the apparatus is incorporated into or attached to the roller hockey goalie leg protective member. For example, for an embodiment of the apparatus that is incorporated into a roller hockey goalie leg protective member, there may be smaller plates with less of a profile, several added rows of ball bearings, and/or more or less than two apparatuses incorporated into a leg protective member.

For example, there may be separate apparatuses of various shapes for the foot, calf & knee areas, with ball bearings throughout each. An embodiment of an apparatus for use in the shin area of a leg protective member may have a roughly rectangular shape, with an embodiment of an apparatus for use in the foot area of a leg protective member possibly having a curved shape. Plates may also be "anatomically" curved to fit the leg pad along the outer edges, regardless of the number of apparatuses used.

Apparatuses may attach or be incorporated into a roller hockey goalie leg protective member in a variety of ways. For example, such means for attaching are anticipated that would allow for easy and/or quick attaching and detaching of the apparatus. An embodiment of an apparatus that may attach by straps may also be strategically designed to avoid contact (and friction) with the straps and a dry surface. For example, strategically placed indented portions and/or slits or slots, and varying strap materials, may be utilized. One embodiment also may include straps with Velcro style fastening.

Although the preferred embodiment of the apparatus described herein may comprise a size and shape intended for standard-sized adult roller hockey goalie leg protective members (which according to current NHL rules, may be a maximum of 11 inches in width), different sizes intended for hockey goalie leg protective members are also anticipated (e.g., small, medium, large, or adult, junior, and youth). Certain shapes of the apparatus may also be implemented in a variety of ways in order to not interfere with the movement and flexion of the roller hockey goalie leg protective member (e.g., not necessary rectangular shapes, or with cut-off corners). Other shapes may be implemented to take advantage of similarities in goalie pads presented by different brands and models.

The above description and listed alternative embodiments are considered that of some embodiments only. It is understood that the embodiments shown in the drawings and described above are merely for illustrative purposes and not intended to limit scope. Alterations and modifications, therefore, and such further applications as would occur to those skilled in the relevant art(s), are also contemplated.

DETAILED DESCRIPTION OF THE PREFERRED EMBODIMENTS

"Roller hockey" is defined herein as a hockey-related activity played on a dry surface, whether players wear inline skates, quad roller skates, or no genre of skates at all. A "roller hockey goalie leg protective member" refers to a leg protective member intended for a goalie to use in "roller hockey."

Figure 1A:
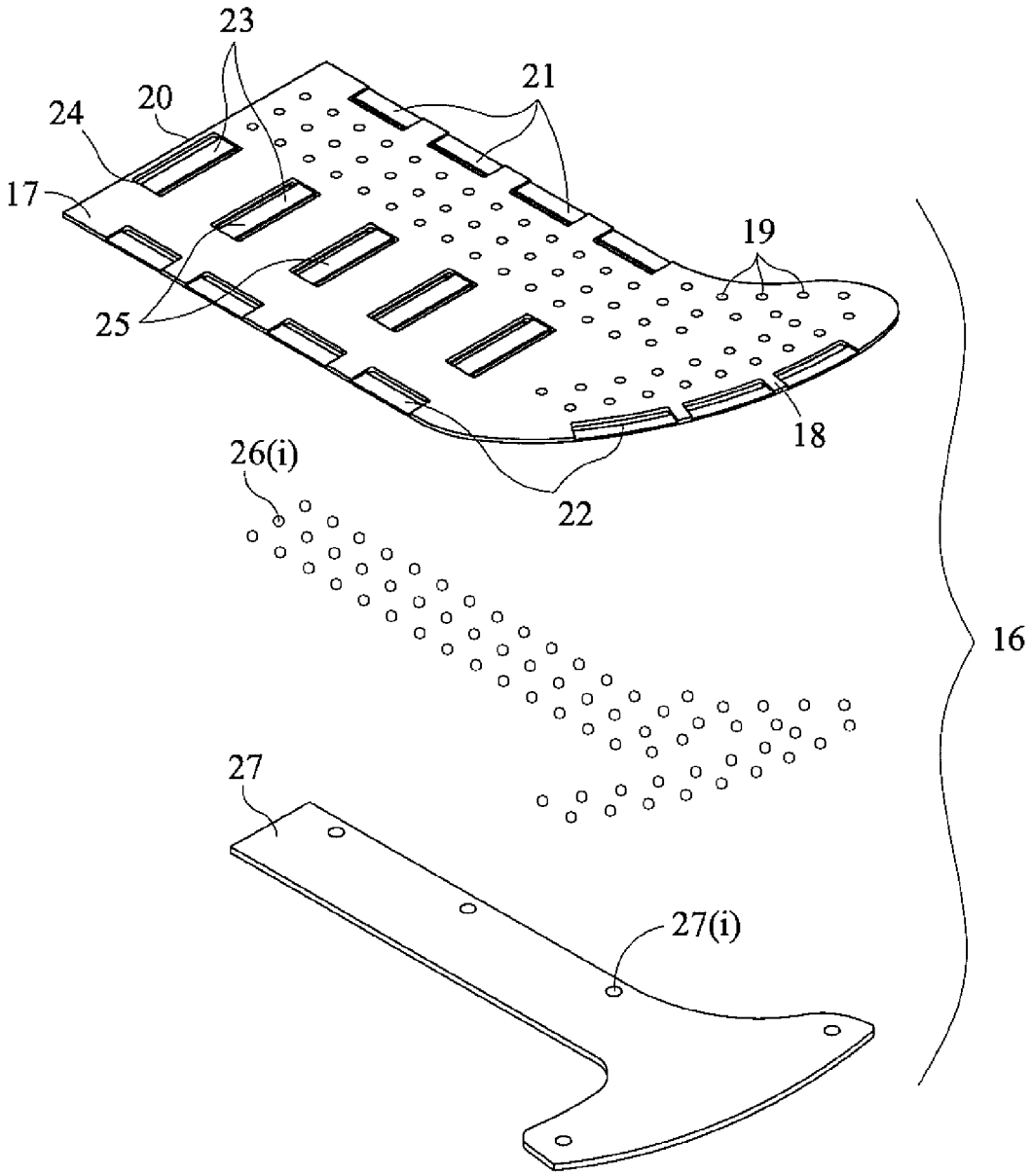
FIG. 1A is a perspective view of an unassembled roller apparatus for a lower area of a roller hockey goalie leg protective member.
Figure 13:
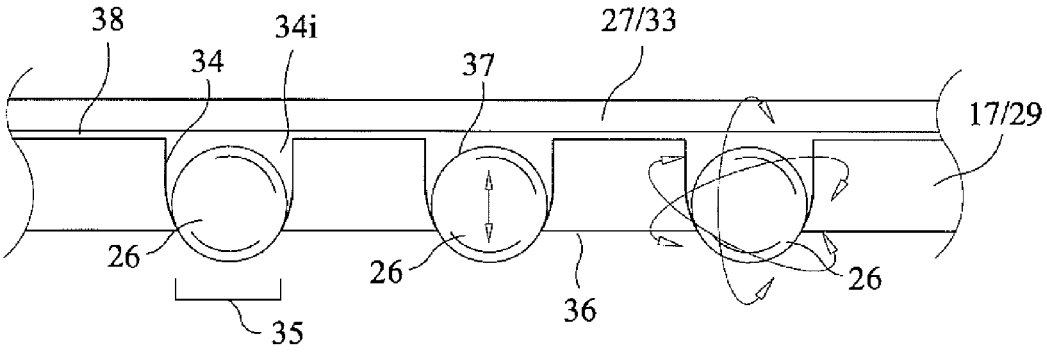
FIG. 13 is an enlarged cross sectional view of a ball bearing in a cavity of either of the apparatuses in FIG. 1A and FIG. 1B.

Referring to the drawings, FIG. 1A illustrates an unassembled rolling apparatus for the lower area of a roller hockey goalie leg protective member 16, which may comprise three main components. A first component may be a plate 17, roughly resembling the shape of a "J" (or the mirror image thereof), or roughly the shape of a boot. Stated differently, the plate 17 may in the shape of a rectangle, except one of the shorter sides 18 of the rectangle is not straight but rather curved in a convex manner and extended on one side beyond the (continued) line of one of the long sides of the rectangle. A plurality of recesses that may form a plurality of cavities 19 may perforate the plate 17, with (as shown in FIG. 13) each cavity 34 passing through both the front (or top) planar surface 36 and the back (or bottom) planar surface 38 of the plate 17.

Along the perimeter of three of the sides of the plate 17 (including the convex side 18, but not including the side 20 opposite of the convex side 18) may be several rectangular recesses 21, indented below the front (or top) planar surface 36 of the plate 17 (also shown in FIG. 6 and in FIG. 13). To the interior of each indented rectangular recess 21 may be a rectangular-shaped slit or hole 22, the hollow portion of which extends through to the back (or bottom) planar surface 38 of the plate 17 (also shown in FIG. 6 and in FIG. 13).

In the middle portion of the plate 17 may also be rectangular recesses 23, indented below the front (or top) planar surface 36, and two parallel rectangular slits or holes 24 within each interior rectangular recess 23 (also shown in FIG. 6 and in FIG. 13). Each slit or hole 24 may be located along the edge or side of each interior rectangular recess 23 that is roughly-parallel with the side of the apparatus 20 that may not have any rectangular recesses 21 located along its perimeter. The hollow portion of each slit or hole 24 may extend through to the back (or bottom) planar surface 38 of the plate 17 (as shown in FIG. 13). This may create an indented bar or board 25 within each rectangular recess 23, contiguous to the edges or sides of the interior rectangular recess 23 that are roughly-perpendicular to the side of the apparatus 20 that does not have any rectangular cavities 21 located along its perimeter.

Figure 3A:
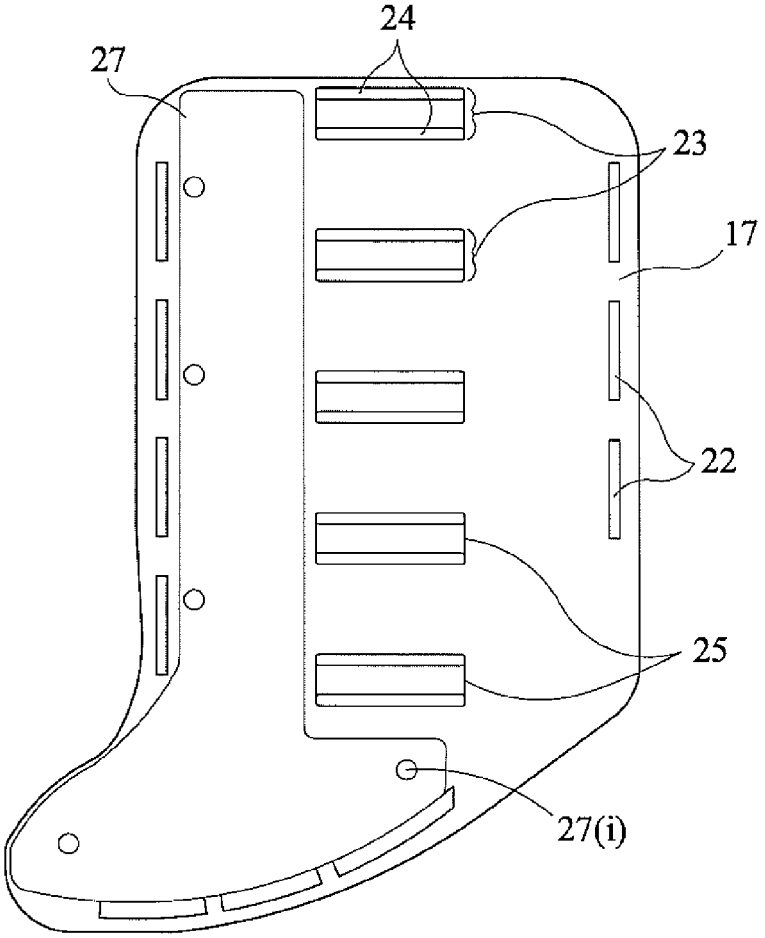
FIG. 3A is a rear view of the roller apparatus in FIG. 1A.
Figure 5A:
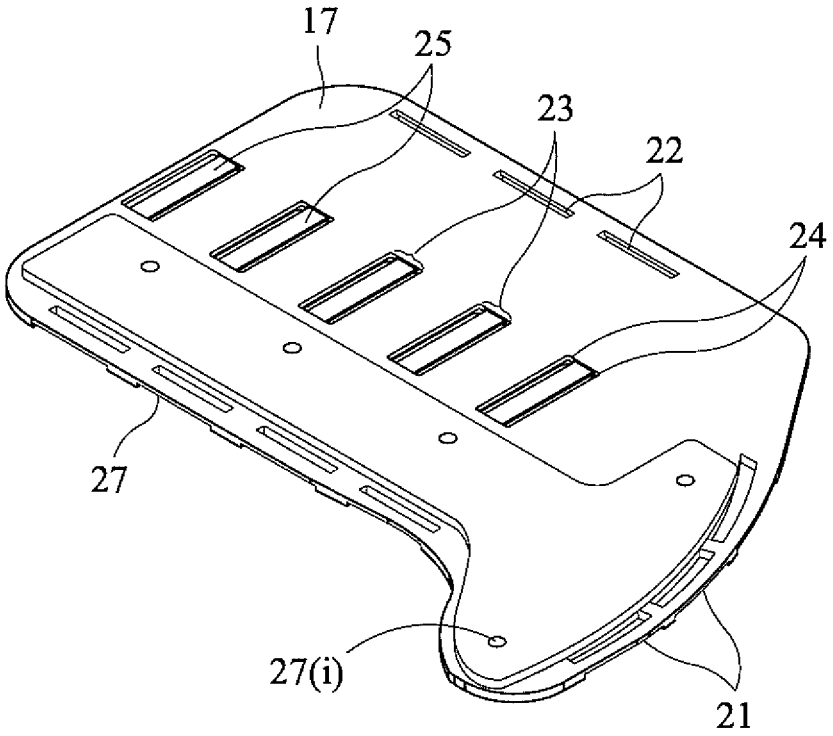
FIG. 5A is a rear perspective view of the roller apparatus in FIG. 1A.

A second component may be a plurality of ball bearings 26(*i*). A third component may be a cap piece 27, which might be roughly in the shape of a "T." The bottom cap piece 27 may be placed against the back (or bottom) surface 38 of plate 17, holding each ball bearing 26 within a cavity 34 (as shown by FIG. 13). Attaching the cap piece 27 to the plate 17 may be facilitated by recesses for fasteners 27(*i*) in the cap piece 27, as shown by back view FIG. 3A and back perspective view FIG. 5A of the assembled apparatus 16 shown by FIG. 1A.

Figure 2A:
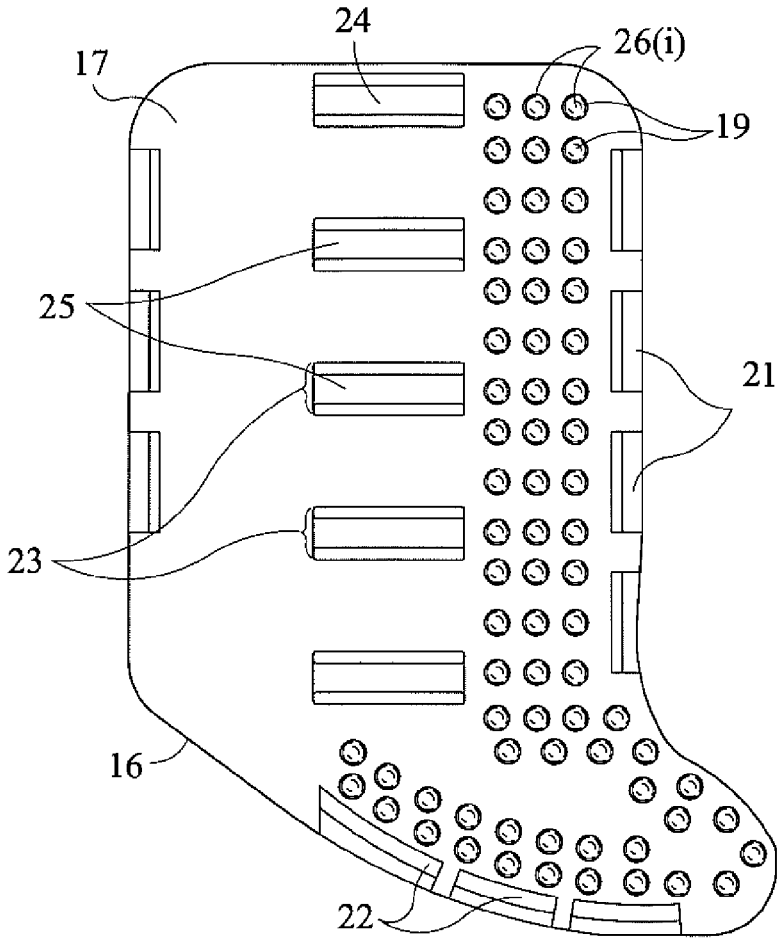
FIG. 2A is a front view of the assembled roller apparatus in FIG. 1A.
Figure 4A:
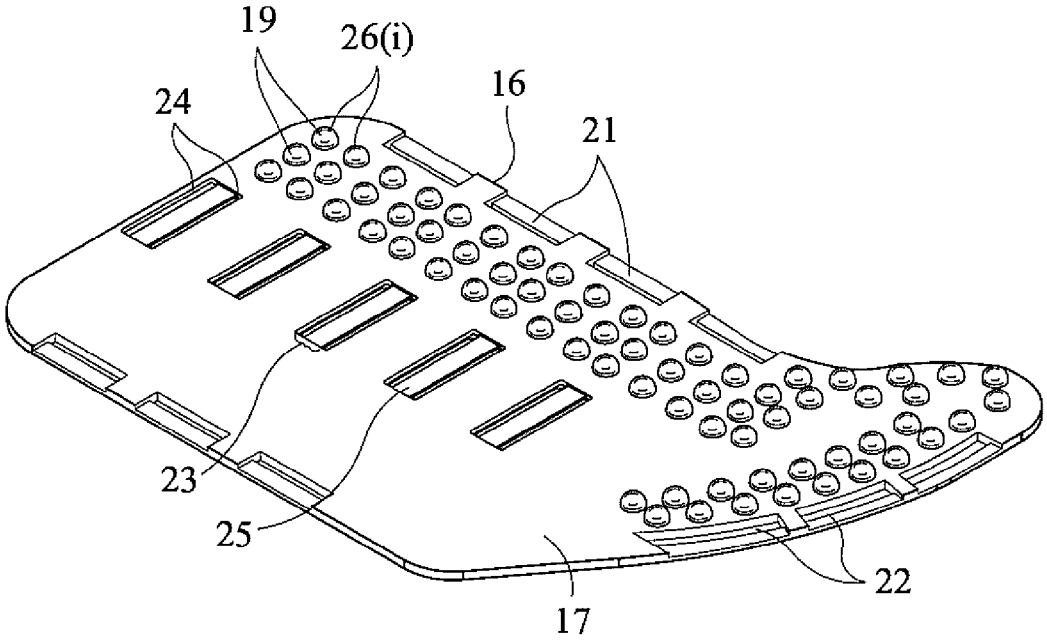
FIG. 4A is a front perspective view of the roller apparatus in FIG. 1A.
Figure 6:
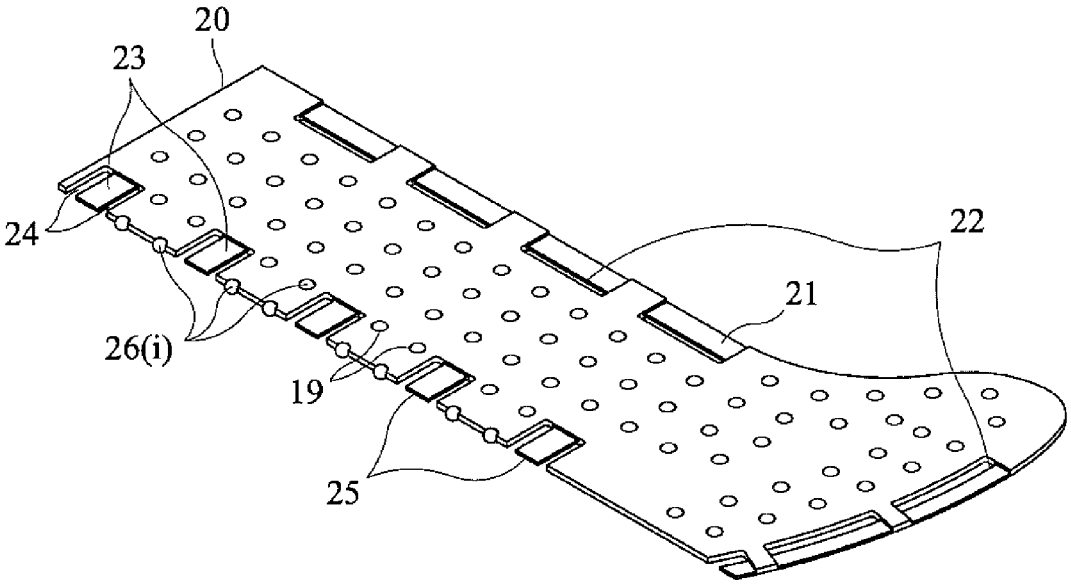
FIG. 6 is a cutaway front perspective view of a portion of the roller apparatus in FIG. 1A.
Figure 7A:
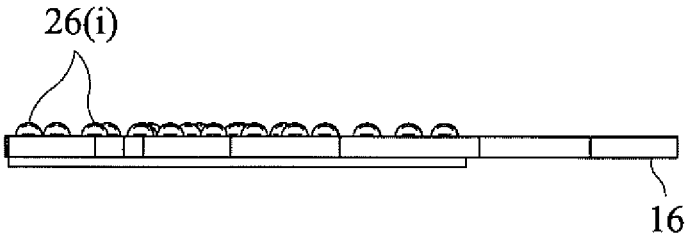
FIG. 7A is a top side view of the roller apparatus in FIG. 1A.
Figure 7B:
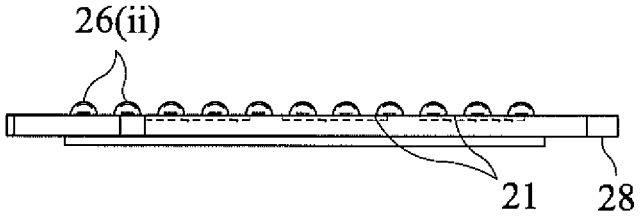
FIG. 7B is a top side view of the roller apparatus in FIG. 1B.
Figure 8A:
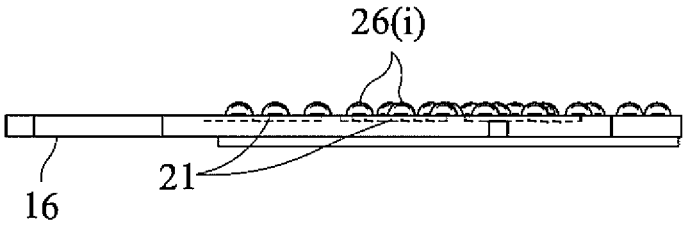
FIG. 8A is a bottom side view of the roller apparatus in FIG. 1A.
Figure 8B:
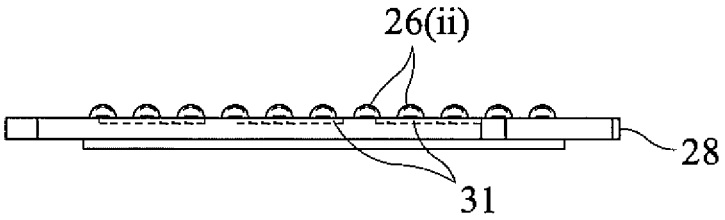
FIG. 8B is a bottom side view of the roller apparatus in FIG. 1B.
Figure 9A:
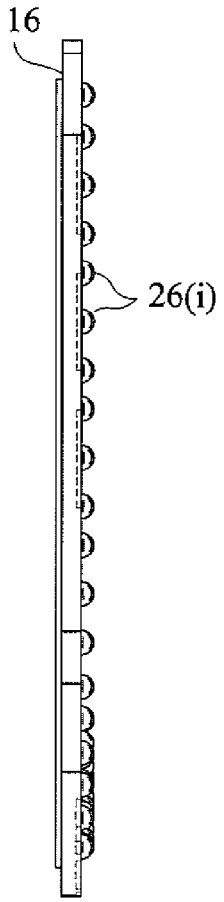
FIG. 9A is a right side elevation view of the roller apparatus in FIG. 1A.
Figure 10A:
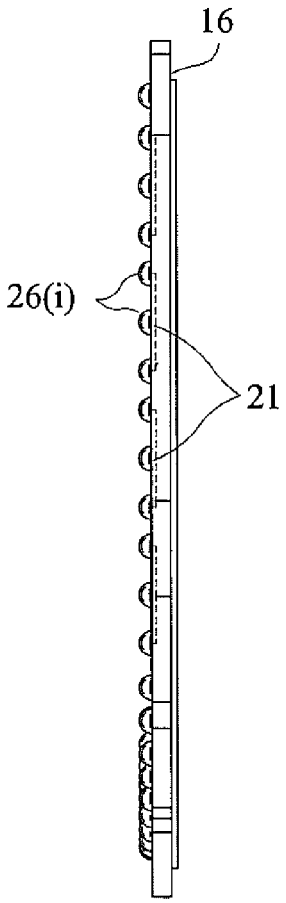
FIG. 10A is a left side elevation view of the roller apparatus in FIG. 1A.
Figure 9B:
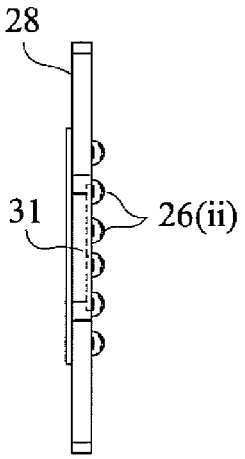
FIG. 9B is a right side elevation view of the roller apparatus in FIG. 1B.
Figure 10B:
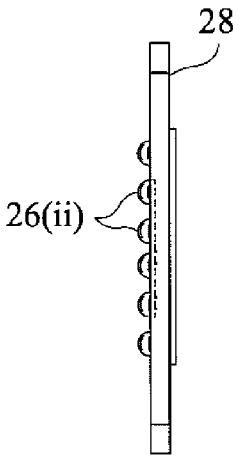
FIG. 10B is a left side elevation view of the roller apparatus in FIG. 1B.

Accordingly, a plurality of ball bearings 26(*i*) may be secured within a plurality of cavities 19 formed by the top plate 17 and bottom cap piece 27 components of the assembled apparatus for the lower area of a roller hockey goalie leg protective member 16, as shown in front view FIG. 2A and front perspective view FIG. 4A, and in cutaway perspective FIG. 6. The plurality of ball bearings 26(*i*) may partially extend beyond the planar surface of apparatus 16 facing views FIG. 2A and FIG. 4A, or in other words beyond the front or top planar surface 36 as shown in FIG. 13.

Figure 1B:
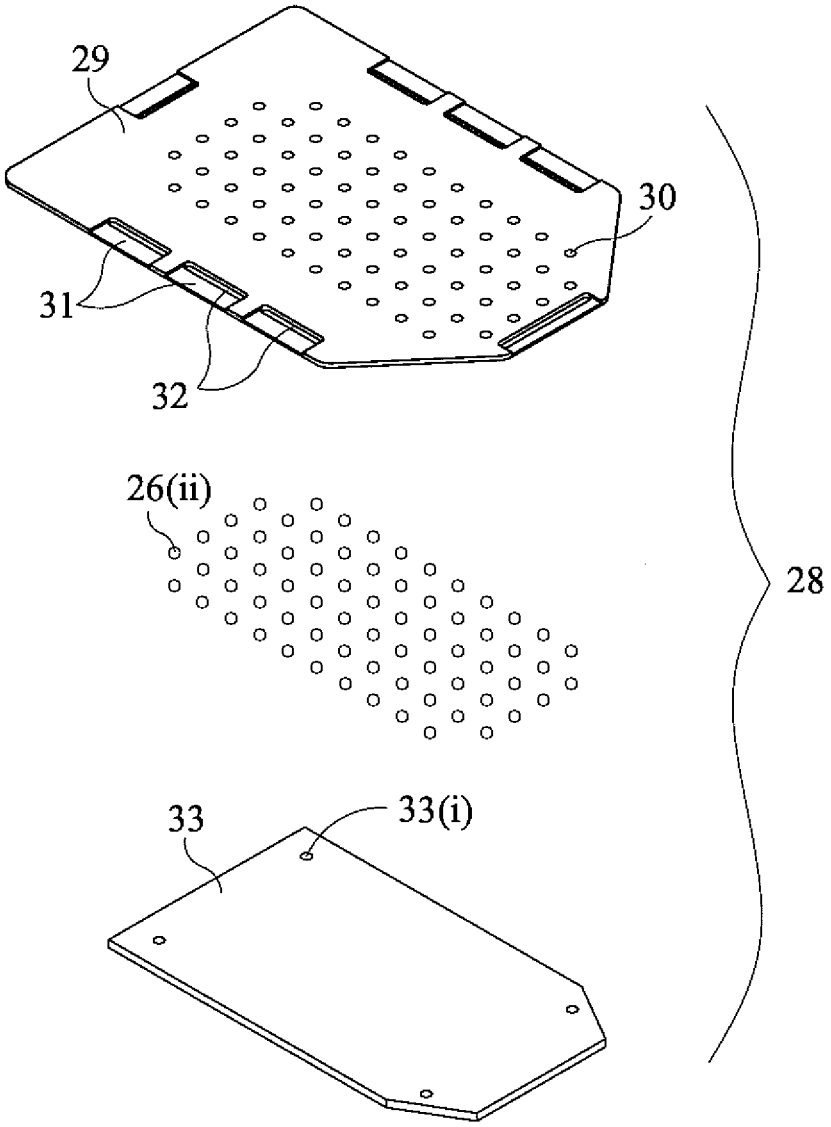
FIG. 1B is a perspective view of an unassembled roller apparatus for a knee area of a roller hockey goalie leg protective member.

FIG. 1B illustrates an unassembled rolling apparatus for the knee area of a roller hockey goalie leg pad 28, which may also comprise three main components. A first component may be a plate 29, roughly in the shape of a rectangle with the corners cut off of one of the shorter sides of the roughly-shaped-rectangle. A plurality of recesses that may form a plurality of cavities 30 may perforate the plate 29, with (as shown in FIG. 13) each cavity 34 passing through both the front (or top) planar surface 36 and the back (or bottom) planar surface 38 of the plate 17.

Along the perimeter of all of the sides of the roughly-shaped rectangle may be rectangular recesses 31 (possibly similar to rectangular cavities 21), indented below the front or top planar surface 36 of the plate 29. Each rectangular indented recess 31 may have, along its side opposite the perimeter of the plate 29 (or, in other words, along the side of the indented rectangular recess 30 that is closest to the interior of the plate 29), a rectangular-shaped slit or hole 32, with the hollow portion of each slit of hole 32 extending through to the back (or bottom) planar surface 38 of the plate 29.

Figure 3B:
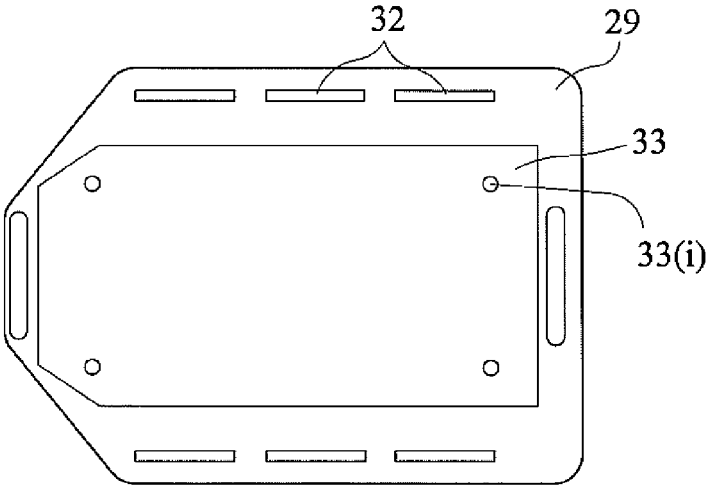
FIG. 3B is a rear view of the roller apparatus in FIG. 1B.
Figure 5B:
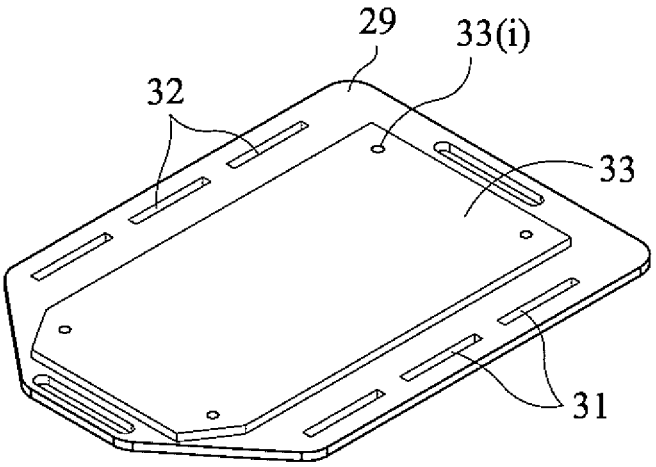
FIG. 5B is a rear perspective view of the roller apparatus in FIG. 1B.

A second component of an unassembled rolling apparatus for the knee area of a goalie leg pad 28 may be a plurality of ball bearings 26(*ii*). A third component may be a bottom cap piece 33, which might be roughly in the shape of a rectangle, with the corners on one of the shorter sides of the rectangle omitted according to the shape of the plate 29. The bottom cap piece 33 may be placed against the bottom surface 38 of plate 29, holding each ball bearing 26 within a cavity 34 (as shown by FIG. 13). Attaching the cap piece 33 to the plate 29 may be facilitated by recesses for fasteners 33(*i*) in the bottom cap piece 33, as shown by back view FIG. 3B, and back perspective view FIG. 5B of the assembled apparatus of FIG. 1B 28.

Figure 2B:
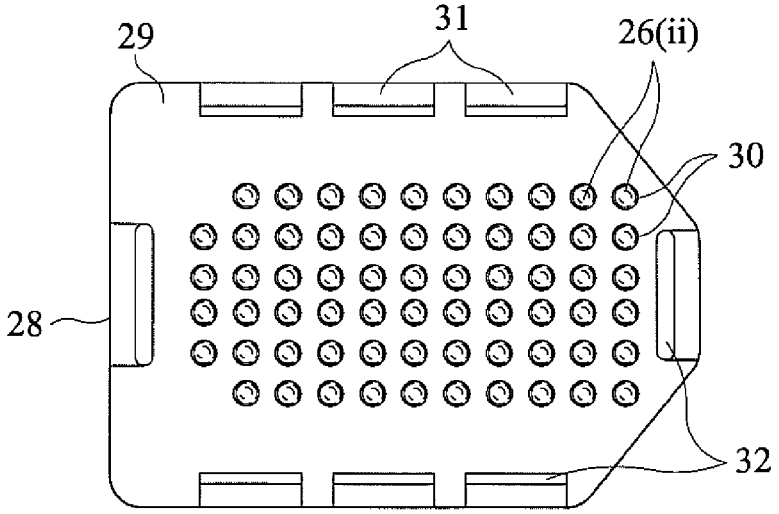
FIG. 2B is a front view of the assembled roller apparatus in FIG. 1B.
Figure 4B:
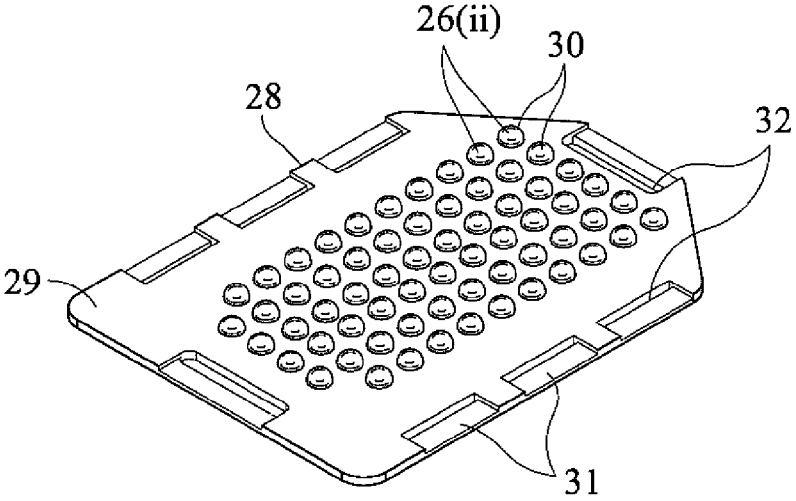
FIG. 4B is a front perspective view of the roller apparatus in FIG. 1B.

Accordingly, as shown in front view FIG. 2B and front perspective view FIG. 4B, a plurality of ball bearings 26(*ii*) may be secured within a plurality of cavities 30 of the plate 29 component of the assembled apparatus for the knee area of a roller hockey goalie leg protective member 28. The plurality of ball bearings 26(*ii*) may slightly protrude beyond the planar surface of apparatus 28 that is facing views FIG. 2B and FIG. 4B, or in other words beyond the front (or top) planar surface 36, as shown in FIG. 13.

More specifically, as shown in FIG. 13, each ball bearing 26 of the pluralities of ball bearings 26(*i*), 26(*ii*) (shown in FIG. 1A and FIG. 1B) sits within a cavity 34. An aperture 35 in the cavity 34 extends through the front (or top) planar surface 36 of the plate 17 or 29. The width of the aperture 35 may be less than the diameter of the ball bearing 26, preventing the ball bearing 26 from escaping the cavity 34 through the aperture 35, yet allowing the ball bearing 26 to partially extend or protrude from the aperture 35. The ball bearing 26 may at times be centered in the aperture 35 and partially extend out of the aperture 35 through some force acting on the ball bearing from the opposite side, such as the force of gravity.

Another aperture 37 of the cavity 34 along the bottom (or back) surface 38 of the plate 17 or 29 may be obstructed by a cap piece 27 or 33, preventing the ball bearing 26 from escaping the cavity 34 through the bottom aperture 37. A recess 34(*i*), or extra space within the cavity 34 may also be provided, which may allow the ball bearing 26 to absorb impact and move farther into the cavity, yet still be free to a greater degree to roll in one or all directions. The cap piece 27 or 33 may be made of a self-lubricating material that may also flex when a ball bearing 26 is pressed against the bottom cap piece 27 or 33. The parts of the plate 17 or 29 defining a cavity 34 may be made of a self-lubricating material.

Figure 11:
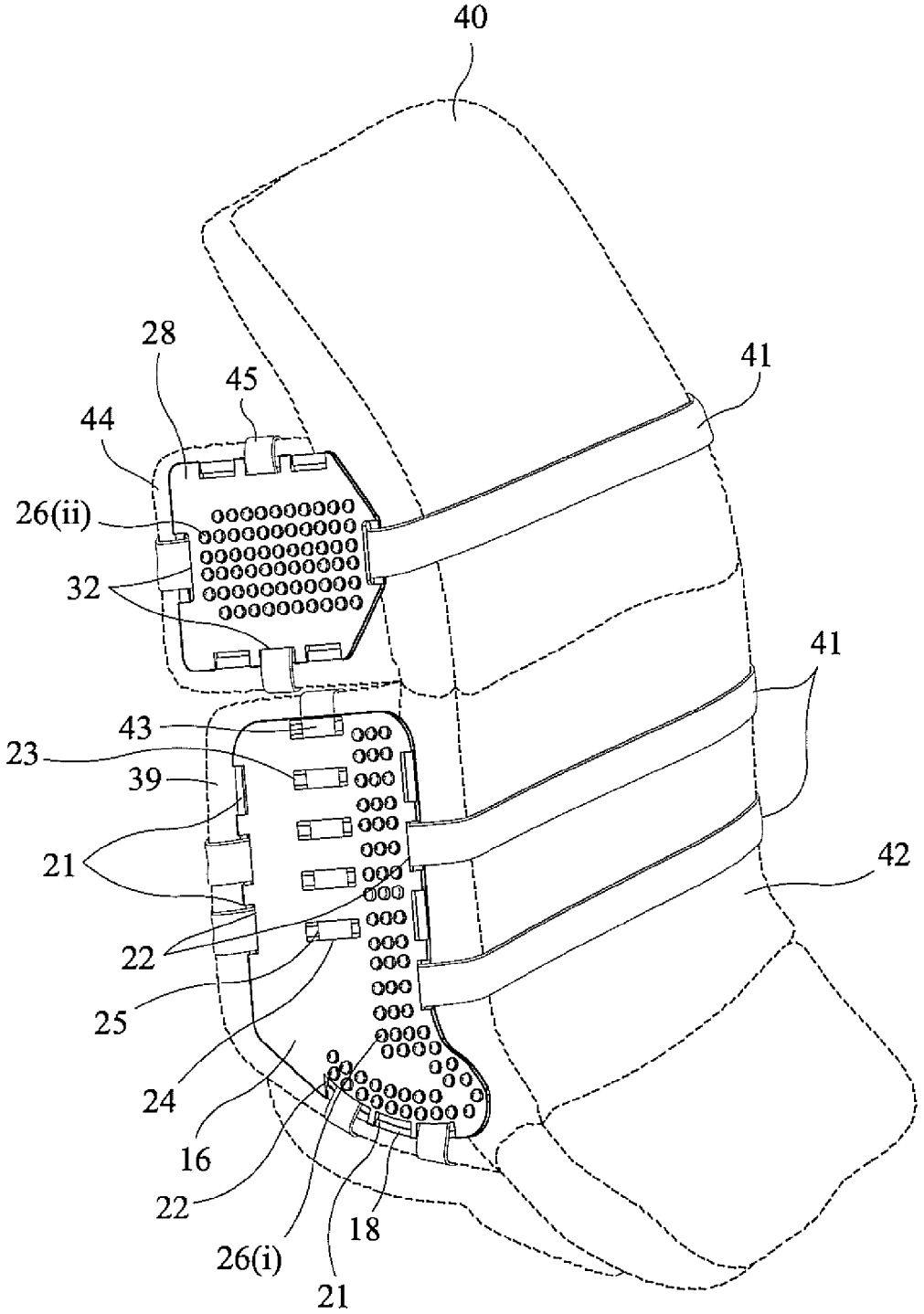
FIG. 11 is a front perspective view of the roller apparatuses in FIG. 1A and FIG. 1B shown in their environment of use installed on a roller hockey goalie leg protective member.
Figure 14:
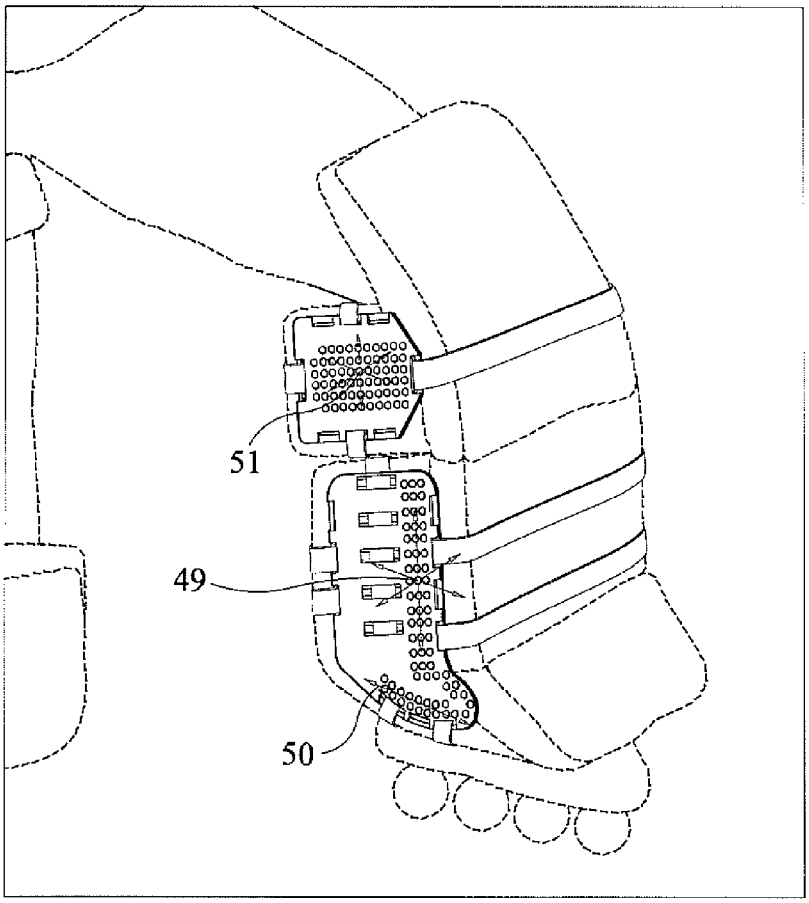
FIG. 14 is a view of the patterning of the ball bearings in rectangular arrays aligned with the player's knee and shin and feet axes.

As shown in FIG. 7A, FIG. 8A, FIG. 9A, FIG. 10A, and in FIG. 11, the plurality of ball bearings 26(*i*) of the assembled apparatus in FIG. 1A 16 may be patterned in arrays according to the shape of a shin landing 39 of a roller hockey goalie leg protective member 40, and as shown more particularly in FIG. 14, in arrays aligned with a roller hockey player's leg axis 49 and foot axis 50. Similarly, as shown in FIG. 7B, FIG. 8B, FIG. 9B, FIG. 10B, and in FIG. 11 the plurality of ball bearings 26(*ii*) of the assembled apparatus in FIG. 1B 28 may be patterned in arrays (e.g., rectangular arrays) according to the shape of a knee landing 44 of a roller hockey goalie leg protective member 40, and as shown more particularly in FIG. 14, in arrays aligned with a hockey player's knee axis 51 (which arrays may facilitate movement in e.g., in both forward and backward, as well as lateral and semi-lateral directions).

Figure 12:
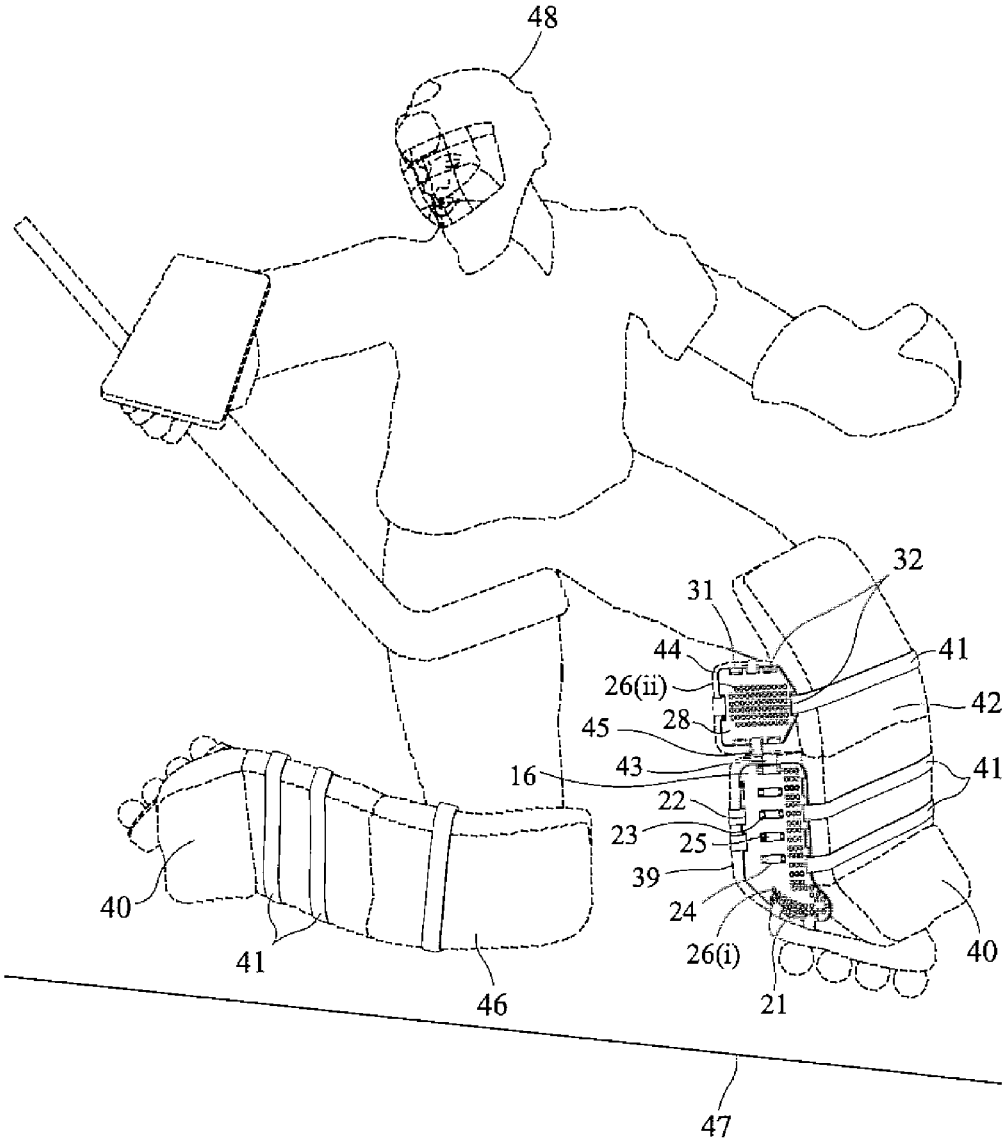
FIG. 12 is a perspective view of the roller apparatuses in FIG. 1A and FIG. 1B shown in their environment of use by a roller hockey goalie.

As shown in FIG. 11, the assembled apparatus of FIG. 1A 16 may be placed on the shin-area landing 39 of a roller hockey goalie leg protective member 40, with the plurality of ball bearings 26(*i*) facing away from the landing 39, and the convex side of the apparatus 18 pointing away from the knee area landing 39 of the roller hockey goalie leg protective member 40. Horizontal straps 41 may pass through the slits 22 of the rectangular indented portions 21 of the apparatus 16, and wrap around the landing 39 and the face of the goalie leg protective member 42, and around the lower leg of the goalie (as shown in FIG. 12) (being tightened and secured through means known in the relevant art(s), such as the use of Velcro). Vertical straps 43 may pass through the interior slits 24 and bars 25 of the interior rectangular indented portions 23 of the apparatus 16, pass over the top of the landing 39 and also connect to the slits 22 located in the indented rectangular portions 21 on the convex side of the apparatus 18.

As also shown in FIG. 11, the assembled apparatus 28 shown in FIG. 1B may be placed on a side of the knee-area landing 44 of a roller hockey goalie leg protective member 40 that may face a dry surface, with the plurality of ball bearings 26(*ii*) facing away from the landing 44. Also, a horizontal strap 41 may pass through slits 32 and wrap around the landing 44 and the face of the leg pad 42, as well as a hockey goalie's upper leg, knee, and or lower thigh area 46 (shown in FIG. 12). A vertical strap 45 may pass through slits 32 and wrap around the landing 44.

As FIG. 12 illustrates, when playing on a dry surface 47, a roller hockey goalie 48 wearing roller hockey goalie leg protective members 40 may place, attach, or strap roller apparatuses 16, 28 to knee and shin area landings 39, 44. This may be accomplished, for example by using straps 41, 43, 45 and slits 22, 24, 32 on apparatuses 16, 28. Indented recesses 21, 23, 31 containing the slits 24, 32 where the straps 41, 43, 45 pass through, may assist to avoid undesired contact of the straps 41, 43, 45 with the playing surface 47. The same rolling apparatuses 16, 28, but mirror images of one another, may be used on the roller hockey goalie's opposite leg protective member.

As shown in FIG. 12, the pluralities of protruding ball bearings 26(*i*), 26(*ii*) of apparatuses 16, 28 may be in contact with a dry surface 47, allowing the ball bearings to roll on the dry surface 47. This rolling, combined with configurations of ball bearings aligned with the goalie's leg 49, foot 50, and knee 51 axes (as shown in FIG. 14), may assist a roller hockey goalie 48 simulate on-ice motions and movements (when, for example, moving from a standing position to a "butterfly" or half "butterfly" position, or when already kneeling in the butterfly position and trying to move to block a puck from entering the goal).

Figure 15:
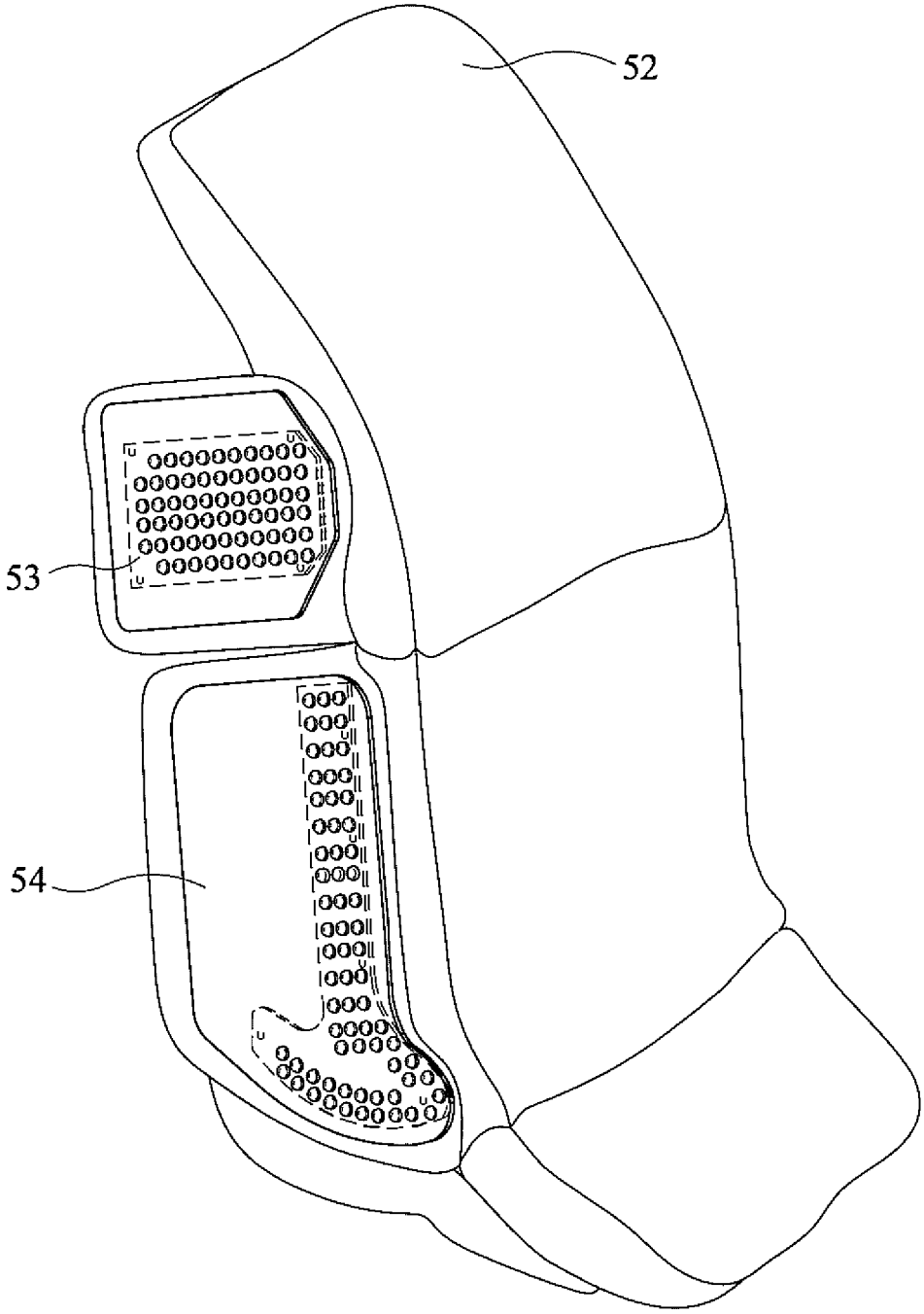
FIG. 15 is a front perspective view of a roller hockey goalie leg protective member, with roller apparatuses incorporated into the landing areas of the protective member.

FIG. 15 illustrates embodiments of the roller apparatuses 53 and 54, incorporated into a roller hockey goalie leg protective member 52, which function to allow movement substantially similar to that described in the preceding paragraph.

I claim:

1. An apparatus for providing rolling movement to a roller hockey goalie's leg protective member, said apparatus comprising:

a roller assembly adapted to be positioned on one or more inner side protective landings of the leg protective member, the roller assembly comprising:

a top plate having a plurality of plate recesses arranged in a planar array;

a bottom cap piece having a planar surface arranged in parallel with the top plate; and a plurality of roller bearings positioned in the plurality of recesses with outer hemispherical sides of the roller bearings projecting outwardly from the top plate of the roller assembly to enable rolling movement of the roller assembly when engaged in contact with a dry surface.

2. The apparatus of claim 1, wherein the apparatus is a roller knee assembly that is to be attached to an inner side knee protective landing of the roller hockey goalie's leg protective member.

3. The apparatus of claim 1, wherein the apparatus is a roller shin assembly that is to be attached to an inner side shin protective landing of the roller hockey goalie's leg protective member.

4. The apparatus of claim 1, wherein the apparatus comprises both a roller knee assembly and a roller shin assembly that are to be attached to an inner side knee protective landing and an inner side shin protective landing, respectively, of the roller hockey goalie's leg protective member.

5. The apparatus of claim 1, wherein the apparatus is a retrofit unit attached by straps to a corresponding inner side protective landing of the roller hockey goalie's leg protective member.

6. The apparatus of claim 1, wherein the apparatus is formed as a unit integrated with a corresponding inner side protective landing of the roller hockey goalie's leg protective member.

7. The apparatus of claim 1, wherein each ball bearing is contained in a cavity formed by the recesses in the top plate and bottom cap piece that provides extra space larger than the dimensions of the ball bearing in order to allow deflection movement of the ball bearing in addition to rolling movement.

8. The apparatus of claim 7, wherein said ball bearing partially extends from said cavity through an aperture in the top plate that is less wide than the diameter of the ball bearing, thereby preventing the ball bearing from escaping the cavity through that aperture.

9. The apparatus of claim 7, wherein a flexible, self-lubricating material is positioned on a bottom side of the cavity opposite from where the ball bearing partially extends, the self-lubricating material being configured to allow the ball bearing to absorb impact yet still rotate in rolling movement.

10. The apparatus of claim 9, wherein the top plate is made of self-lubricating material.

11. The apparatus of claim 1, wherein there is a second aperture opposite the aperture from which the ball bearing partially extends, over which is placed the bottom cap piece for preventing the ball bearing from escaping through the second aperture.

12. The apparatus of claim 11, wherein the bottom cap piece is made of self-lubricating material that flexes when a ball bearing absorbs impact, thereby allowing the ball bearing to withdraw further into the cavity yet still rotate in rolling movement.

13. The apparatus of claim 1, wherein the ball bearings are arranged in arrays according to the shape of the one or more inner side protective landings.

14. The apparatus of claim 1, wherein the apparatus is attached to a corresponding inner side protective landing by a strap or straps.

15. The apparatus of claim 14, wherein the apparatus is configured to prevent friction between straps and the dry surface.

16. A roller assembly for a protective leg member for a roller hockey goalkeeper, comprising:

a top plate and a bottom cap piece adapted to be joined in parallel with each other and having respective plate recesses arranged in a planar array for holding a plurality of ball bearings therebetween with outer hemispherical sides of the ball bearings projecting outwardly from a top plane of the roller assembly to enable rolling movement of the the protective leg member when engaged in contact with the dry surface;

wherein the top plate comprises at least a first planar surface and the bottom cap piece comprises at least a second planar surface, the first planar surface arranged in parallel with the second planar surface.

17. The apparatus of claim 16, wherein each ball bearing is contained in a cavity formed by the recesses in the top plate and bottom cap piece that provides extra space larger than the dimensions of the ball bearing in order to allow deflection movement of the ball bearing in addition to rolling movement.

18. The apparatus of claim 17, wherein said ball bearing partially extends from said cavity through an aperture in the top plate that is less wide than the diameter of the ball bearing, thereby preventing the ball bearing from escaping the cavity through that aperture.

19. The apparatus of claim 17, wherein a flexible, self-lubricating material is positioned on a bottom side of the cavity opposite from where the ball bearing partially extends, the self-lubricating material being configured to allow the ball bearing to absorb impact yet still rotate in rolling movement.

20. An apparatus for providing rolling movement to a roller hockey goalie's leg protective member of the type having a thigh pad, knee pad, shin pad, and foot pad portions joined together, the apparatus comprising:

a roller assembly located configured to be positioned on at least one of an inner side knee protective landing of the knee pad and an inner side shin protective landing of the shin pad, the roller assembly comprising:

a top plate having at least a first planar surface and configured for rolling movement when the roller assembly is engaged in contact with a dry surface;

a bottom cap piece having at least a second planar surface arranged in parallel with the first planar surface.

* * * * *